US005423635A

United States Patent [19]

Keller et al.

[11] Patent Number: 5,423,635

[45] Date of Patent: Jun. 13, 1995

[54] ANCHORING ELEMENT

[75] Inventors: Roland Keller, Bertschikon; Urs Albrecht-Dessimoz, Rikon, both of Switzerland

[73] Assignee: Paul Keller Ingenieurburo A.G., Dubendorf, Switzerland

[21] Appl. No.: 988,932

[22] PCT Filed: Jun. 29, 1992

[86] PCT No.: PCT/CH92/00127

§ 371 Date: May 10, 1993

§ 102(e) Date: May 10, 1993

[87] PCT Pub. No.: WO93/01361

PCT Pub. Date: Jan. 21, 1993

[30] Foreign Application Priority Data

Jul. 10, 1991 [CH] Switzerland ..... 2059/91

[51] Int. Cl.[6] ..... E21D 20/02

[52] U.S. Cl. ..... 405/262; 405/258; 405/259.5

[58] Field of Search ..... 405/262, 259.1–259.6, 405/284, 258; 52/223.13, 53, 57, 63

[56] References Cited

U.S. PATENT DOCUMENTS 3,967,421 7/1976 Dufossez ..... 52/223.13 X
4,449,855 5/1984 Langwadt ..... 52/223.13 X
4,557,007 12/1985 Daiguji et al. ..... 52/223.13 X
4,592,181 6/1986 Matt ..... 52/223.13
4,594,827 6/1986 Finsterwalder ..... 52/223.13
4,619,088 10/1986 Ripoll Garcia-Mansilla ... 52/223.13
5,079,879 1/1992 Rodriguez ..... 52/223.13

*Primary Examiner*—Dennis L. Taylor
*Attorney, Agent, or Firm*—Egli International

[57] ABSTRACT

An anchoring element (6) for anchoring a ground anchor (1) to a structural part (2) to be supported, for the purpose of enabling the intactness of a closed protective tube (4), which encloses strands (3) of the ground anchor (1) in the borehole and protects the said strands from corrosion, to be checked by applying a voltage between the strands (3) and earth and measuring the resultant current, even after the uppermost section of the ground anchor (1) has been grouted with a cement compound in a guide-through duct (13) in the anchoring element (6) and the latter has likewise been grouted in an anchor conduit (14), is made from electrically insulating material, preferably polyamide, at least to the extent that no electrically conductive connection exists between the strands (3) and the cement compound in the guide-through duct (13), on the one hand, and between the cement compound outside the said guide-through duct and the structural part (2), on the other hand.

26 Claims, 5 Drawing Sheets

ANCHORING ELEMENT

The invention relates to an element for to the preamble of claim 1.

Anchoring elements of this type are used above all in civil engineering for anchoring strands of a ground anchor, having an anchor head which is sunk by a few metres up to some tens of meters in the ground and is anchored there by grouting with a cement compound, at their upper end to the structural part, for example a supporting wall, which is to be held.

A ground anchor of this type essentially comprises a plurality of steel strands having a sheathing, usually made out of an anticorrosion compound and a plastics tube, which steel strands are guided in a closed polyethylene protective tube which, for better anchorage, is ribbed in the region of its lower end and the outer side of which, for better anchorage, is provided in the region of the lower end with circumferential corrugations. The protective tube reaches back into the guide-through duct in the anchoring element and terminates there, while the strands are pulled fully through the guide-through duct and protrude over the opening in the anchoring plate.

The anchor head is grouted by cement being introduced, next to the protective tube, into the borehole and by the region of the borehole situated outside the protective tube being filled in, while the volume enclosed by the protective tube is likewise filled with cement through a hose which is guided in the protective tube and reaches through the guide-through duct up to the surface.

The anchorage of the ground anchor to the structural part is carried out by an anchor bushing being mounted onto the outer surface of the anchoring plate, the anchor bushing having an opening for each strand through which the strand is pulled. The strands are then tensioned while being supported on the anchor bushing, until the desired traction, generally measuring several tons in total, is obtained.

Since the strands have to endure very high traction, it is very important that they should also be protected as far as possible against corrosion in the inaccessible region, in particular in the region of the anchor head. It is known, after the strands have been tightened, to check once again whether the protective tube, critically important for the corrosion protection, is intact, the check being carried out, in fact, by applying a voltage between the strands and earth and measuring the resultant current. Since the protective tube is electrically insulating, whereas the surrounding cement compound and the soil are, even if only slightly, conductive, the measured current provides indication of whether and, if so, to what extent the protective tube is damaged. If the ground anchor is intact, then the guide-through duct is filled at least partially with cement compound and the interspace between the anchoring element and an anchor conduit, which is embedded in the structural part, is also grouted with the same compound.

In the case of known anchoring elements which are made totally from metal, the grouting produces between the strands and earth a short circuit which precludes, furthermore, any check being carried out on the intactness of the protective tube. The effect of this is that any damage to the protective tube which occurs after the completion of the anchorage cannot be detected. As a result, very dangerous situations can arise unnoticed since, if the protective tube is not intact, the strands can corrode and tear off, thereby possibly resulting in the collapse of a supporting wall with consequences such as the after-slippage of earth masses, the collapse of buildings etc.

SUMMARY OF THE INVENTION

The invention is intended to provide a remedy in this regard. The invention provides an anchoring element in which, even after the anchor socket and the anchor conduit have been filled, there is no short circuit present between the strands and earth, thereby enabling the protective tube to be checked at any time, even after the completion of the anchorage. This allows impairments of the corrosion protection to be detected at any time and remedial measures to be introduced before the strands lose their functionality. Dangerous situations are thus largely preventable.

BRIEF DESCRIPTION OF THE DRAWINGS

The invention is explained more fully below with reference to drawings representing purely illustrative embodiments, in which.

DETAILED DESCRIPTION OF THE PREFERRED EMBODIMENT

Figure 1:
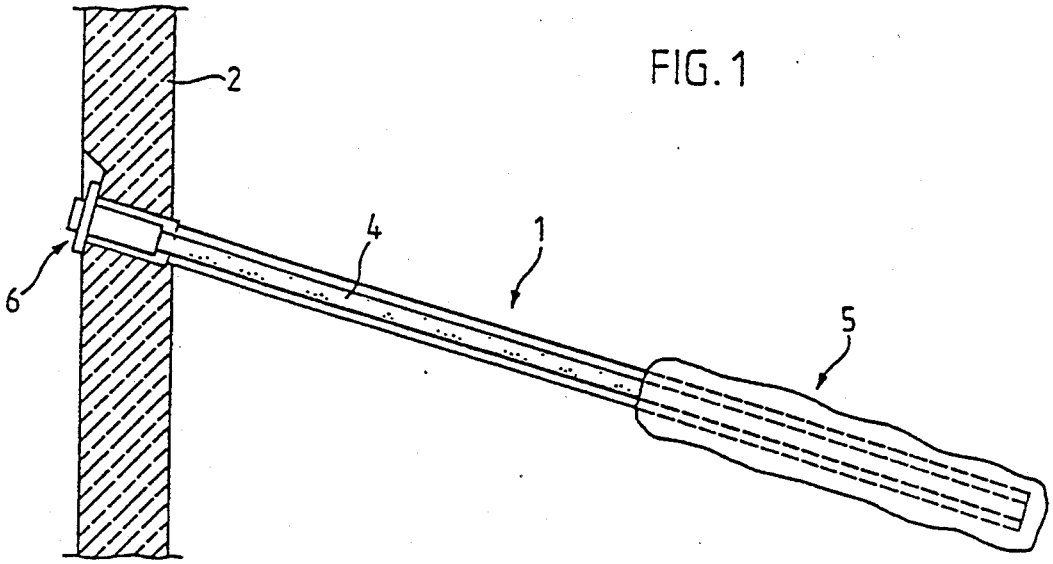
FIG. 1 shows, in longitudinal section, a general representation of a ground anchor.

The ground anchor 1 represented in FIG. 1 (see also FIG. 2) for anchoring a structural part 2 comprises a plurality of strands 3 which are guided in a polyethylene protective tube 4, this being sunk into a bore housed to a depth of several meters to several tens of metres in the ground. In the end region, in the anchor head 5, for better anchorage in the surrounding cement compound with which it is externally and internally grouted, the protective tube 4 is ribbed. The grouting is effected by introducing the cement compound into the borehole next to the protective tube 4 and by filling the volume enclosed by the protective tube 4 by means of an injection hose (not represented) guided in the protective tube. In this way, the strands 3 are very firmly anchored in the borehole. They exhibit, apart from on the uppermost section of the ground anchor 1, as additional corrosion protection, a casing (not represented) made from an anticorrosion compound and a plastic tube.

At the upper end, the protective tube 4 reaches into an anchoring element 6, to be more precise into its anchor socket 7, and terminates there, while the strands 3 are guided through the tubular anchor socket 7 and through a circular opening 8, surrounded by the anchor socket, in a square anchoring plate 9, against whose supporting surface 10 the anchor socket 7 bears, and beyond an outer surface 11, lying opposite the supporting surface 10, of the anchoring plate 9. The inside of the anchor socket 7, from a guide-through opening 12, through which there is guided the protective tube 4 with the strands 3, to the mouth of the opening 8 in the outer surface 11, forms a guide-through duct 13 in which the uppermost section of the ground anchor 1 is guided.

The anchoring element is mounted in an anchor conduit 14 in the structural part 2 which is intended to be held by the ground anchor 1.

Figure 2:
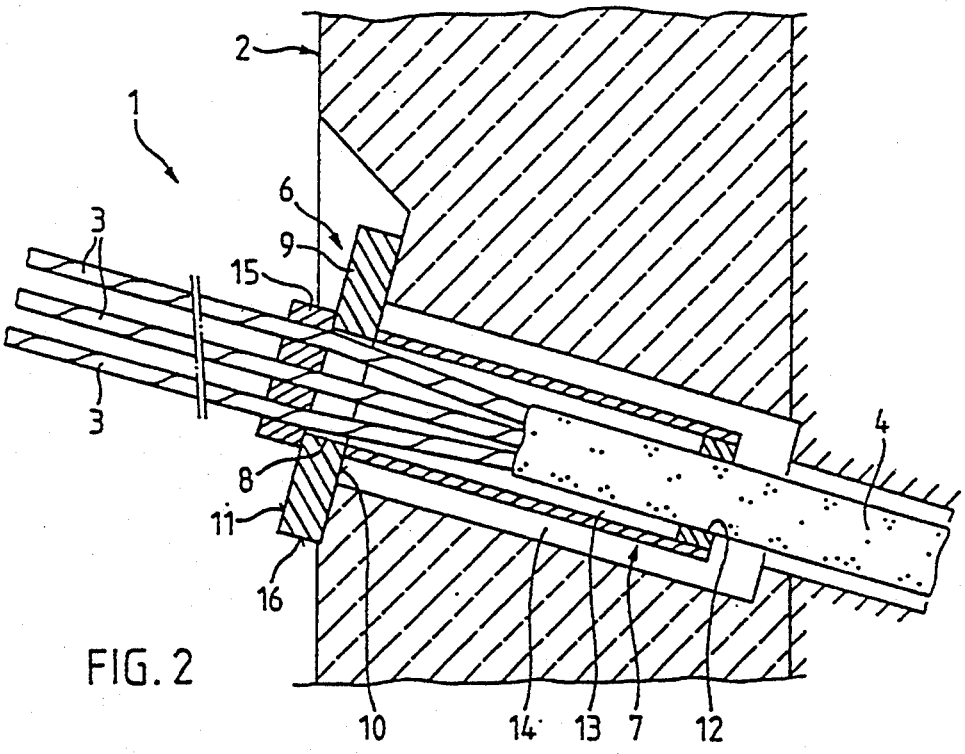
FIG. 2 shows, in detailed representation, the uppermost section of the ground anchor according to FIG. 1, complete with anchor conduit and anchoring element.

In the assembly stage represented in FIGS. 1, and 2, the anchor head is already grouted with cement. The strands 3 are guided through an anchor bushing 15, which for each strand 3 exhibits an opening, and have been tensioned while being supported on the anchor bushing. They exert onto the anchor bushing 15, which is supported on the outer surface 11 of the anchoring plate 9, a traction of several tons.

The checking of the protective tube 4 now usually ensues by applying a voltage between the upper ends of the strands 3 and earth and monitoring the resultant current. Since the protective tube 4 consists of electrically insulating material, there can be virtually no current flowing, provided it is intact. If, however, there is a leak somewhere, then a current flows across the cement compound and the soil, which current indicates an impairment of the corrosion protection.

Provided the protective tube 4 is intact, the guide-through duct 13 is now filled at least partially with cement compound, the interspace between the outer side of the anchor socket 7 and the anchor conduit 14 likewise being grouted with cement compound.

In the case of an anchoring element 6 according to the invention, at least the limit surface of that region of the guide-through duct 13 which comes into contact with the cement compound, i.e. at least a section of the guide-through duct adjoining the guide-through opening 12, is now formed by an electrically insulating material, preferably plastic—though other materials, e.g. ceramic, may also be considered. Consequently and as a result of the insulation of the anchor bushing 15 from the outer surface 11 of the anchoring plate 9, e.g. by virtue of an insulating intermediate layer, and as a result of adequate sealing of the guide-through opening 12 through which the ground anchor 1 is guided, any electrical connection between the strands 3 and the cement compound in the guide-through duct 13, on the one hand, and between the cement compound outside the anchor socket 7 and the structural part 2 and the surrounding soil, on the other hand, is eliminated.

If a voltage is applied between the upper ends of the strands 3 and earth, then—just as prior to the grouting—current is able to continue flowing only through any cracks in the protective tube 4. The measurement of the current therefore continues to provide indication of the intactness of the protective tube, thereby enabling permanent monitoring or periodic checking to be carried out after completion of the anchorage and enabling dangerous impairments of the corrosion protection of the strands 3 to be detected at an early stage.

For safety reasons, it is advisable to form at least the entire limit surface of the guide-through duct 13 and ideally also the outer surface 11 of the anchoring plate 9 from insulating material, since moisture or a spatter of cement can otherwise easily give rise to creep paths, which falsify the measurement or render it impossible.

It is advisable, in any event, to configure at least that part of the outer surface 11 on which the anchor bushing 15 is supported to be of insulating design, so that further measures for the reciprocal insulation of the anchor bushing 15 and of the anchoring plate 9 are not necessary.

Instead of insulating the anchoring element 6 on the inside, it can also, in principle, be insulated on the outside, i.e. against the grouting compound filled between the anchoring element 6 and the anchor conduit 14 and against the structural part 2. In this case, at least the surface of the anchor socket 7, insofar as it is situated outside the guide-through opening 12, and the supporting surface 10 of the anchoring plate 9, preferably also the outer surface 11 and marginal surfaces 16 which laterally limit the anchoring plate 9 and connect the outer surface 11 to the supporting surface 10, must consist of insulating material.

It has proved beneficial in practice to provide a double safety protection and to configure the anchoring element 6 such that its entire surface is formed by electrically insulating material.

Figure 3A:
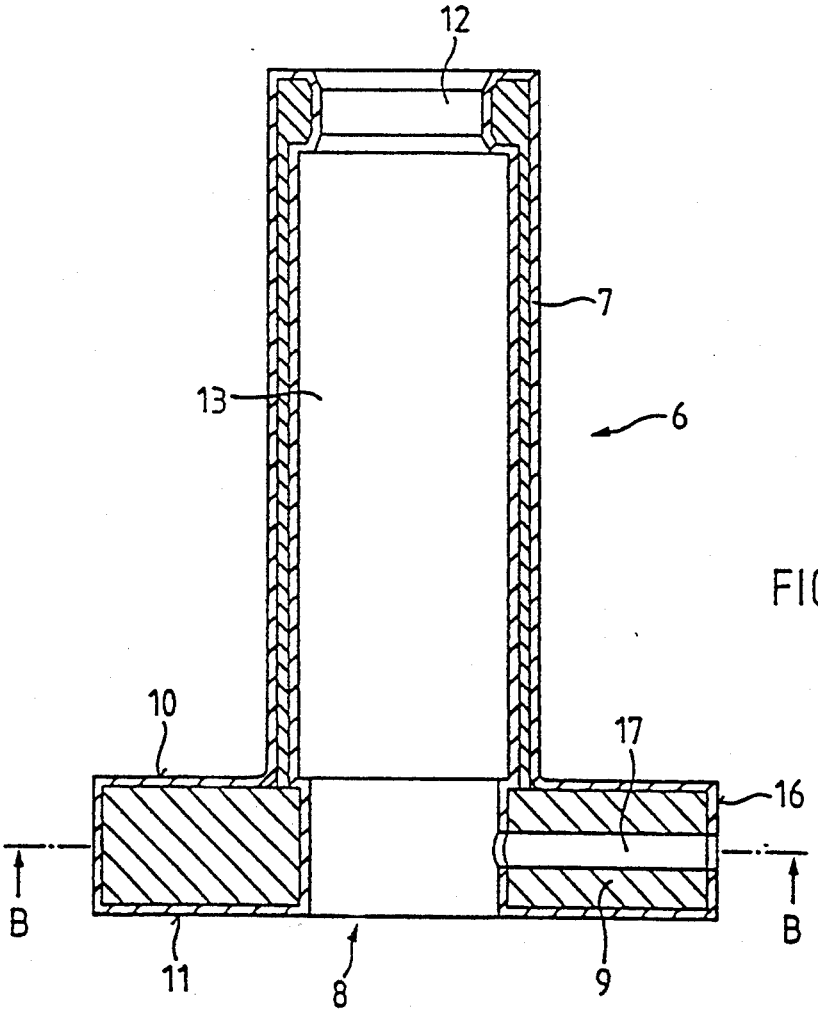
FIG. 3*a* shows a first embodiment of an anchoring element according to the invention in the longitudinal section according to A—A in FIG. 3*b*.
Figure 3B:
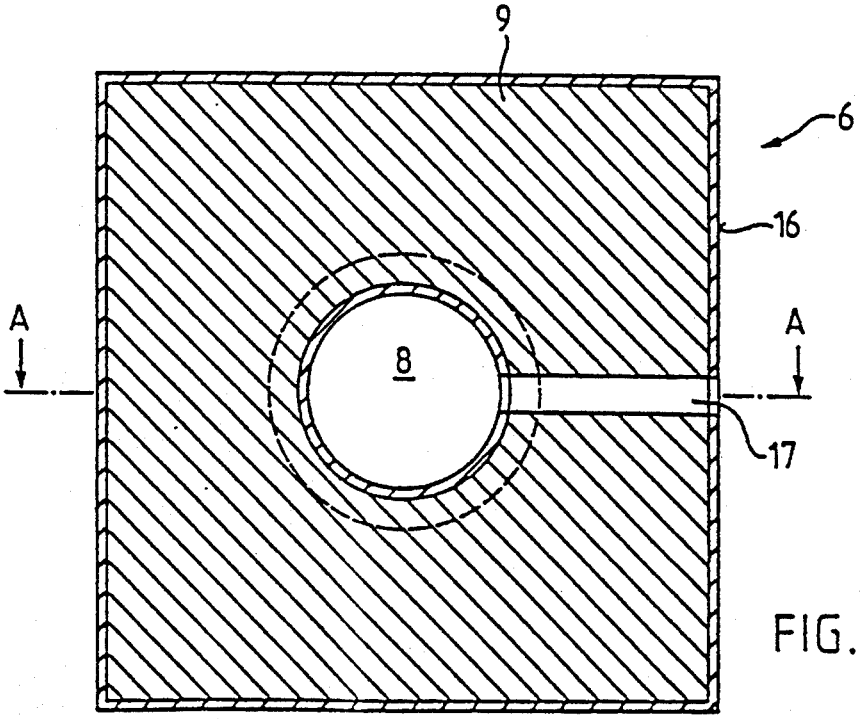
FIG. 3*b* shows a cross-section along B—B in FIG. 3*a*, FIGS. 4*a,b* show a second embodiment of an anchoring element according to the invention in representations corresponding to those of FIGS. 3*a,b*, FIGS. 5*a,b* show a third embodiment of an anchoring element according to the invention in representations corresponding to those of FIGS. 3*a,b*.

A first embodiment, represented in FIGS. 3*a* and *b*, shows an anchoring element 6 which is made in the conventional manner from steel.

According to the invention however, both the anchor socket 7 and the anchoring plate 9 are completely coated in plastic, preferably polyamide. From the marginal surface 16, a pour-in bore 17 reaching up to the opening 8 is made, which pour-in bore serves, during grouting, to introduce the cement compound into the interior of the anchor socket 7.

Figure 4A:
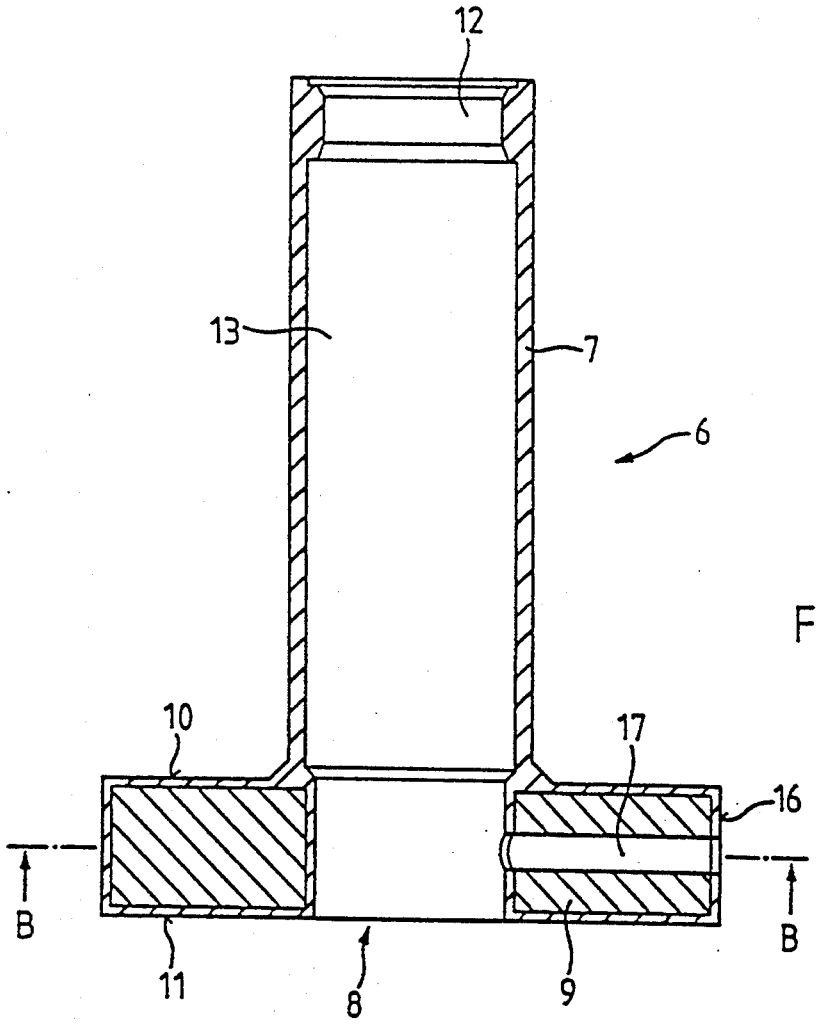
Figure 4B:
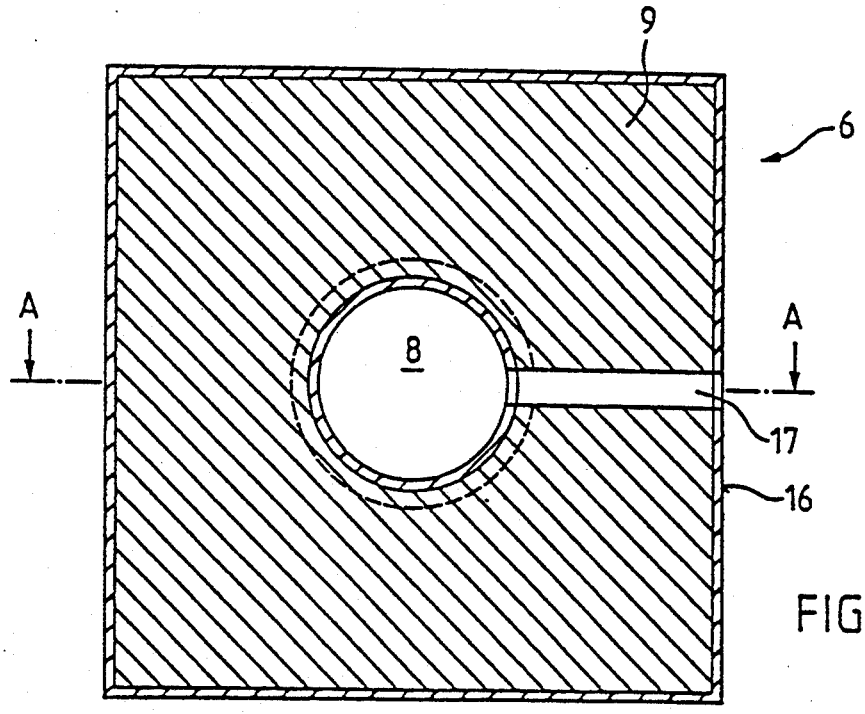

The anchoring element 6 according to the invention as shown in FIGS. 4*a,b* has broadly the same construction, the only difference from that represented in FIGS. 3*a,b* being that the anchor socket 7 consists totally of polyamide, whilst the anchoring plate 9 is configured as a universally polyamide-coated steel plate.

Figure 5A:
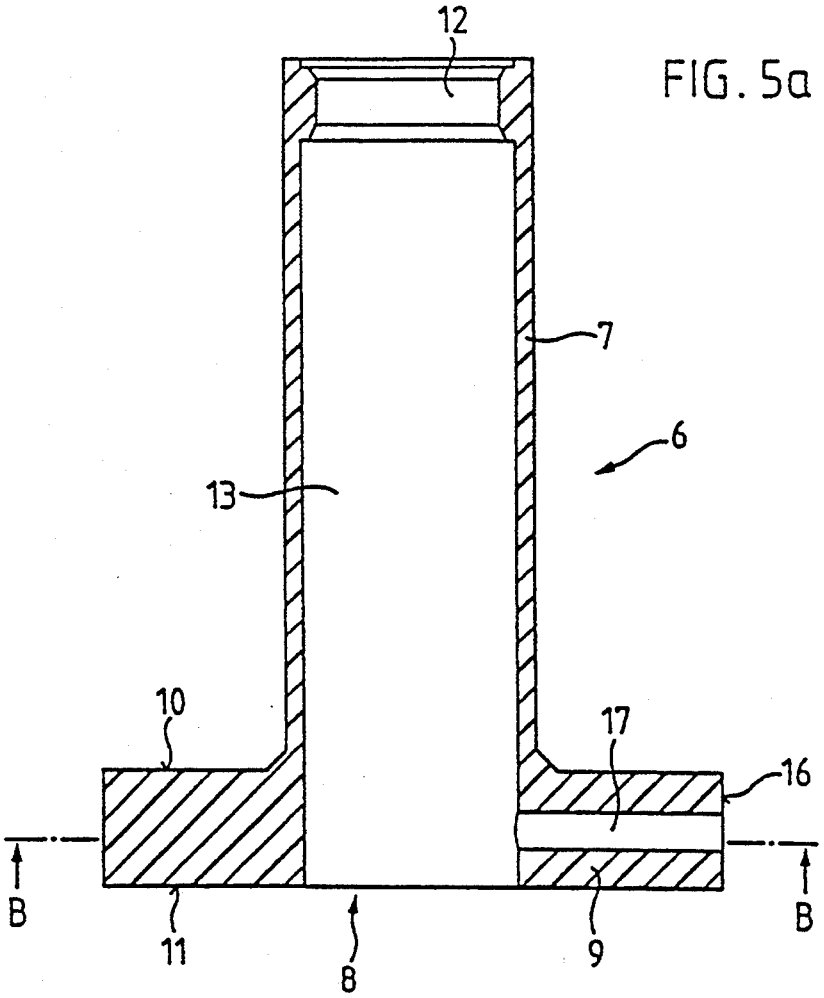
Figure 5B:
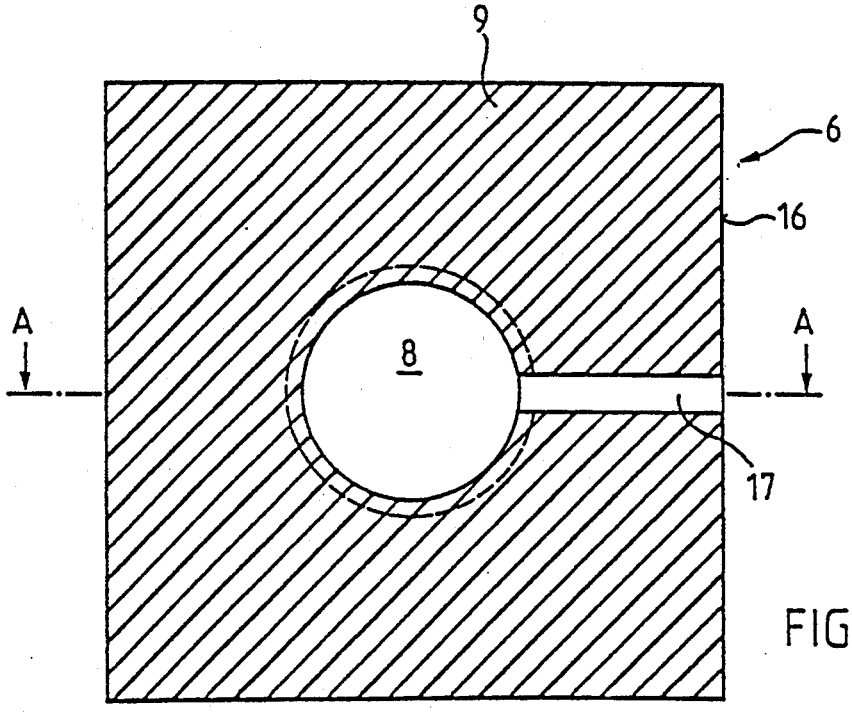

The anchoring element 6 according to the invention as shown in FIGS. 5*a,b* corresponds in structure to the two described above, but consists wholly of polyamide.

Due to its high mechanical strength, polyamide is particularly suitable for use in anchoring elements according to the invention, but the use of other, in some circumstances even several different, electrically insulating materials is also possible.

Reference has already been made to the fact that it is critically important for the invention-conforming functioning of the anchoring element 6 that the guide-through opening 12 should be sealed such that no electrical connection exists between the grouting compounds in the guide-through duct 13 and outside the anchor socket 7. A sealing of this kind can be achieved in principle by a seal clamped in the region of the guide-through opening 12 between the wall of the guide-through duct 13 and the outer side of the protective tube 4 or by grouting the guide-through opening 12 with an electrically insulating compound. Both methods are not however very reliable under the conditions prevailing on a building site.

Figure 6:
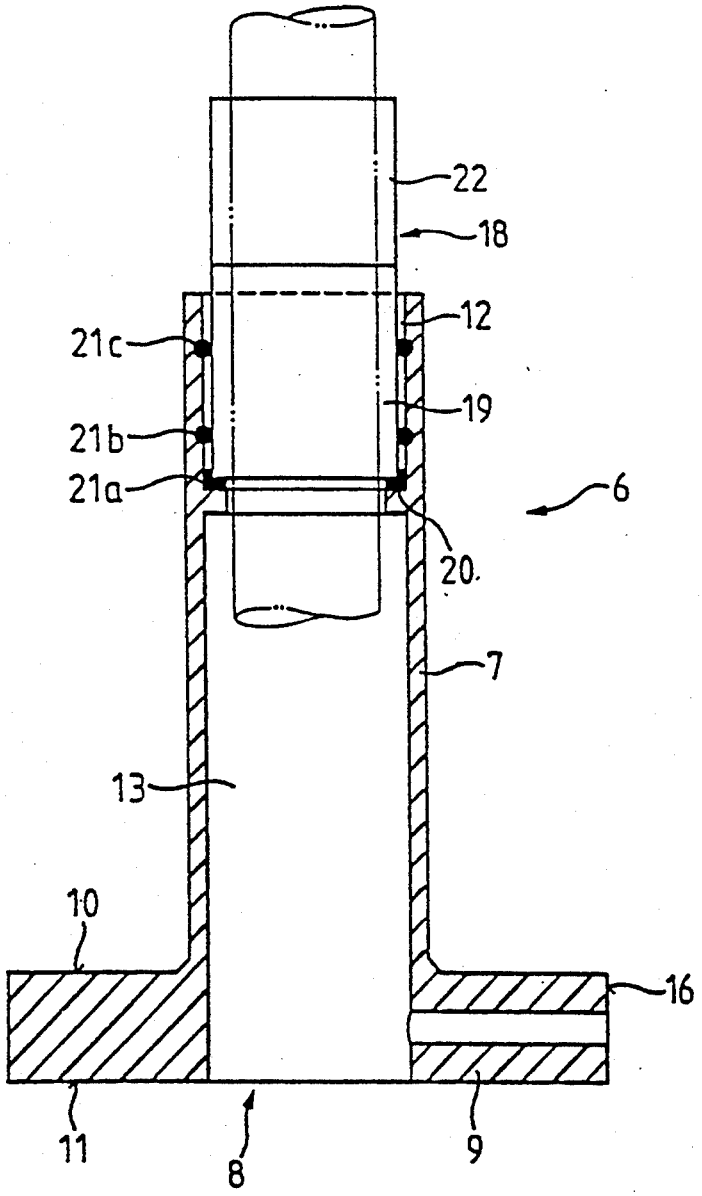
FIG. 6 shows a fourth embodiment of an anchoring element according to the invention in longitudinal section.

By contrast, an adequate sealing can be very easily obtained using the anchoring element 6 represented in FIG. 6. This exhibits a tubular piece 18, which is inserted by a sealing section 19 into the guide-through opening 12 as far as a shoulder 20 forming a stop. Between the end face of the tubular piece 18 and the shoulder 20 there is clamped a sealing ring 21*a*, e.g. made from rubber, which is followed, up towards the end of the anchor socket 7, by two further sealing rings 21*b,c* clamped between the outer side of the sealing section 19 and the inner wall of the guide-through duct 13, so that the connection between the tubular piece 18 and the anchor socket 7 is reliably seal-tight. The sealing section 19 is adjoined by an electric-welding sleeve 22 connected to the said sealing section by flush welding.

For sealing purposes, the electric-welding sleeve 22 is charged with current and fused to the outer side of the protective tube 4. Whilst the welding sleeve 22 contracts slightly, the sealing section 19 is not affected by the welding, so that the seal-tightness of its connection to the anchor socket 7 is not impaired.

We claim:

1. A corrosion protected anchoring element for anchoring a ground anchor to a structural part, allowing for controlled checking for corrosion protection, comprising:

an anchoring plate, having an outer surface, a supporting surface opposite the outer surface, and an opening; and, an anchor socket arranged so as to bear against the supporting surface and surround the opening so that the opening and an inner surface of at least a portion of the anchor socket form a guide-through duct for guiding through an uppermost section of the ground anchor, the guide-through duct being closed off at its end remote from the anchoring plate by a guide-through opening, a tube made of electrically insulating material and having two ends, sealingly closing the opening, the tube extending into the ground with one end and the other end extending through the opening into the guide-through duct, the tube provides for anchoring a plurality of strands extending along through the tube from the end in the ground through the opening of the anchoring plate, whereby controlled checking for corrosion protection is provided by electrical measurements between the strands and the earth, a limit surface of at least a section of the guide-through duct adjoining the guide-through opening being formed by electrically insulating material.

2. An anchoring element according to claim 1, wherein the entire limit surface of the guide-through duct is formed from electrically insulating material.

3. An anchoring element according to claim 1 wherein at least part of the outer surface of the anchoring plate which surrounds the opening is formed from electrically insulating material.

4. An anchoring element according to claim 3, wherein the entire surface is formed from electrically insulating material.

5. An anchoring element according to claim 1, wherein the anchor socket consists wholly of electrically insulating material.

6. An anchoring element according to claim 5, wherein the anchoring element consists wholly of electrically insulating material.

7. A corrosion protected anchoring element for anchoring a ground anchor to a structural part allowing for controlled checking for corrosion protection, comprising: an anchoring plate having an outer surface, a supporting surface, and an opening; and an anchor socket arranged so as to bear against the supporting surface and surround the opening so that the opening and an inner surface of at least a portion of the anchor socket form a guide-through duct for guiding through the uppermost section of the ground anchor, the ground anchor fixedly housing a plurality of strands, the guide through duct being closed off at its end remote from the anchoring plate by a guide-through opening for sealed through-guidance of the ground anchor, at least the supporting surface, an outer surface of the anchor socket and, a section of an inner surface of the anchor socket lying outside the guide-through opening and marginal surfaces connecting the outer and inner surface are formed from electrically insulating material, whereby conductivity measurements between the strands and earth indicate degrees of corrosion protection.

8. An anchoring element according to claim 7, wherein the outer surface of the anchoring plate and marginal surfaces connecting the outer surface and the supporting surface are formed from electrically insulating material.

9. An anchoring element according to claim 1, wherein at least part of the electrically insulating material is polyamide.

10. An anchoring element according to claim 3, wherein the anchoring plate is one of an iron and steel plate coated on both sides with polyamide.

11. An anchoring element according to claim 1, and further comprising a tubular piece that is essentially coaxial with the anchor socket and is connected thereto in a sealing manner, at least a portion of the tubular piece being an electric-welding sleeve.

12. An anchoring element according to claim 11, wherein the tubular piece and the anchor socket are slid telescopically one inside the other and between the outer side of one and an inner side of the other are clamped a number of sealing rings.

13. An anchoring element according to claim 12, wherein at least two sealing rings are provided.

14. An anchoring element according to claim 12, wherein the tubular piece comprises a sealing section that contacts the sealing rings and is axially adjoined by the electric-welding sleeve.

15. An anchoring element according to claim 12, wherein the tubular piece is inserted into the guide-through duct.

16. An anchoring element according to claim 15, wherein the guide-through duct has an internal shoulder that forms a stop for the tubular piece.

17. An anchoring element according to claim 16, wherein a sealing ring is clamped between an end face of the tubular piece and the shoulder.

18. An anchoring element according to claim 7, wherein at least part of the electrically insulating material is polyamide.

19. An anchoring element according to claim 8, wherein the anchoring plate is one of an iron plate and a steel plate coated on both sides with polyamide.

20. An anchoring element according to claim 7, and further comprising a tubular piece that is essentially coaxial with the anchor socket and is connected thereto in a sealing manner, at least a portion of the tubular piece being an electric-welding sleeve.

21. An anchoring element according to claim 20, wherein the tubular piece and the anchor socket are slid telescopically one inside the other and between an outer surface of one and an inner surface of the other are clamped a number of sealing rings.

22. An anchoring element according to claim 21, wherein at least two sealing rings are provided.

23. An anchoring element according to claim 21, wherein the tubular piece comprises a sealing section that contacts the sealing rings and is axially adjoined by the electric-welding sleeve.

24. An anchoring element according to claim 21, wherein the tubular piece is inserted into the guide-through duct.

25. An anchoring element according to claim 24, wherein the guide-through duct has an internal shoulder that forms a stop for the tubular piece.

26. An anchoring element according to claim 25, wherein a sealing ring is clamped between an end face of the tubular piece and the shoulder.

* * * * *